United States Patent [19]

Mudiare

[11] 4,040,872

[45] Aug. 9, 1977

[54] PROCESS FOR STRENGTHENING OF CARBON STEELS

[75] Inventor: Edeki Mudiare, Chicago, Ill.

[73] Assignee: LaSalle Steel Company, Chicago, Ill.

[21] Appl. No.: 677,742

[22] Filed: Apr. 16, 1976

[51] Int. Cl.[2] ..... C21D 9/52

[52] U.S. Cl. ..... 148/12 B; 148/12 F; 148/12.4; 148/36; 148/154

[58] Field of Search ..... 148/12 B, 12 F, 154, 148/12.4, 36

[56] References Cited

U.S. PATENT DOCUMENTS

| | | | |
|---|---|---|---|
| 3,178,324 | 4/1965 | Grange et al. | 148/154 |
| 3,507,710 | 4/1970 | Grange et al. | 148/12 F |
| 3,666,572 | 5/1972 | Nakagawa et al. | 148/12.4 |
| 3,699,797 | 10/1972 | Tournoy | 148/12 B |
| 3,855,013 | 12/1974 | Prohaszka et al. | 148/154 |
| 3,865,636 | 2/1975 | Suzuki et al. | 148/12 F |

*Primary Examiner*—W. Stallard

[57] ABSTRACT

A process for the strengthening of carbon steels wherein a hypoeutectoid carbon steel workpiece, preferably in the shape of a rod or a bar, is rapidly heated to a temperature completely within the austenite region at a rate sufficient to minimize grain growth of austenite grains, the resulting austenitized steel workpiece is quenched to transform the steel to a fine mixture of acicular proeutectoid ferrite and a finely divided eutectoid aggregate of ferrite and iron carbide, followed by working at a temperature ranging up to the critical lower temperature to strengthen the steel. The process of the invention provides a drastic increase in both strength and ductility as compared to untreated steels such as those obtained by hot rolling.

31 Claims, 8 Drawing Figures

HOT ROLLED MICROSTRUCTURE OF 1018 (1000X)

MICROSTRUCTURE OF 1018 AFTER PROCESSING (1000X)

PROCESS FOR STRENGTHENING OF CARBON STEELS

This invention is directed to a process for the strengthening of steels, and particularly to a method for the strengthening of hypoeutectoid carbon steels to improve strength and maintain ductility.

It is well known that the working of hot rolled steel bars and/or rods, as by extrusion, drawing, rolling, etc., serves to increase the strength of the workpiece. However, the strength which can be achieved by such working is dependent upon several different factors. The first is the strengthening of the hot rolled steel from the mill subjected to working. That strength depends, in large measure, upon the carbon content of the steel. The second factor is the response of the steel to working.

For example, it has been demonstrated in U.S. Pat. Nos. 2,767,835, 2,767,836, 2,767,837 and 2,767,838, that the response of a steel to working can be improved by carrying out the working operation at an elevated temperature. This concept is now known as dynamic strain aging, and has been used for many years to increase the increment of strength improvement obtained by working hot rolled steel workpieces.

The third factor affecting the strength obtainable by working a hot rolled workpiece is the degree of working to which the workpiece is subjected. In general, the more the steel is subjected to working, the greater is the strength obtained up to a maximum, beyond which no further increase in strength can practically be realized. That increase in strength is accompanied by a decrease in ductility.

After exhausting the foregoing methods of increasing the strength of the hot rolled material by working, one skilled in the art can, in accordance with existing technology, only turn to heat treating processes to obtain any further increase of strength. For example, it is known, as described in U.S. Pat. No. 3,053,703, that the response of a steel to hardening can be significantly increased by subjecting the steel workpiece to heat treatment followed by elevated temperature drawing. Related concepts are described in U.S. Pat. Nos. 2,998,336, 2,924,544, 2,924,543, 2,881,108 and 2,881,107.

As is described in the foregoing patents, there are basically three approaches to the heat treatment of the hot rolled steel. In each case, a hot rolled steel bar is heated to a temperature sufficient to convert the steel to austenite and then is cooled by any of three conventional techniques:

1. Rapid quenching to form martensite, a transformation product having high strength but poor machinability. Martensite is difficult to produce from a plain carbon steel.
2. Rapid cooling to a temperature for conversion of the austenite to bainite, another transformation product having improved strength and ductility, and somewhat improved machinability as compared to martensite. Bainite is similarly difficult to produce from plain carbon steels.
3. Slow cooling for conversion to a ferrite-pearlite structure. That conversion is the one most easily obtained from a plain carbon steel. However, such a conventional ferrite-pearlite structure provides little or no advantage in terms of mechanical properties, including strength and ductility, as compared to the hot rolled material.

In the first two approaches outlined above, the basic purpose of the heat treating step, where used to obtain an increase in strength, is to effect a refinement in the microstructure by the introduction to the steel of martensite, bainite or mixtures thereof. However, it is necessary, for any steel for which strength is required over a substantial section size, to use an alloy steel to effect the introduction of martensite or bainite. In steels low in alloy content, to convert the austenite to martensite, it is necessary to employ a violent quench to effect the desired transformation. And such a drastic quench frequently leads to quench-cracking.

Further refinements in the martensitic or bainitic microstructures can only be obtained with great difficulty and questionable economic advantages. For example, it has been proposed in U.S. Pat. No. 3,178,324 to subject a steel to thermal treatment to reduce the grain size thereof and obtain an increase in strength. In the process of that patent, the steel is subjected to multiple cycles of austenitizing and quenching. At the end of each but the last quench cycle, a fully martensitic product is required as a starting point for the subsequent cycle. Thus, to produce a fully martensitic product, the process of that patent is restricted, as a practical matter, to alloy steels having greater hardenability than carbon steels.

A similar process is described in U.S. Pat. No. 3,278,345, utilizing multiple cycles of heating, working and quenching. That process, however, is subject to the same deficiencies as described above for it, too, requires a fully martensitic product prior to each subsequent cycle. Thus, both processes are quite expensive due to the necessity for multiple cycles.

It is accordingly an object of the present invention to provide an improved carbon steel and process for the production of same wherein the steel is characterized by an increased level of strength as compared to that of hot rolled carbon steels.

It is a more specific object of the invention to produce and to provide a method for producing a low carbon steel in which the microstructure is carefully controlled to provide significantly increased strength on working.

It is a related object of the invention to produce and provide a method for producing a low carbon steel in which the microstructure is carefully controlled to provide a steel having significantly increased strength and ductility on working as compared to steels produced by working of hot rolled steel, while retaining a high level of machinability.

These and other objects and advantages of the invention will appear more fully hereinafter, and, for purposes of illustration and not by way of limitation, an embodiment of the invention is shown in the accompanying drawings in which.

Figure 1:
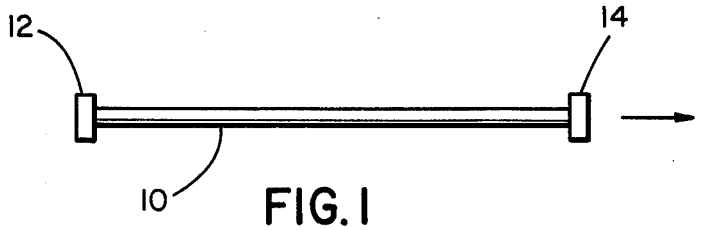
FIG. 1 illustrates the preferred method of heating the steels in the practice of this invention.

The concepts of the present invention reside in the discovery that unusually high levels of strength over substantial section sizes can be achieved in even a low carbon steel. In the practice of this invention, a hypoeutectoid carbon steel is subjected to rapid heating to a temperature sufficient to cause transformation of the steel to austenite.

Thereafter, the austenitic steel is quenched to transform the austenite to a fine mixture of acicular proeutecoid ferrite and a finely divided eutectoid aggregate of ferrite and iron carbide. It has been found, in accordance with this invention, that the rapid heating followed by quenching to produce the fine mixture described above produces a steel whose strength can be significantly increased by working as compared to the increase in strength obtainable by working, to the same extent, of hot rolled steel. In addition, steels produced in accordance with the concepts of this invention have strengths significantly higher than those characteristic of hot rolled steels, while exhibiting a high level of ductility and machinability.

In carrying out the process of this invention, a hypoeutectoid carbon steel, such as a carbon steel containing from 0.1 up to the eutectoid carbon level, and preferably from 0.1 to 0.5% by weight carbon, is subjected to rapid heating to effect complete conversion of the steel to austenite. The temperature at which such conversion occurs varies with the carbon content of the steel, and complete conversion to austenite generally ranges from 1,350° to 2,000° F, although, as will be appreciated by those skilled in the art, time and temperature are somewhat interrelated. It is thus possible to employ lower temperatures where the steel is retained at the elevated temperature for greater periods of time. In general, however, it is preferred to effect the heating in less than 10 minutes, to minimize grain growth of the austenite being formed. Best results are usually obtained when the steel is heated to the desired austenitizing temperature in a time ranging from 1 second to about 5 minutes.

In accordance with the preferred practice of this invention, the rapid heating to the austenitizing temperature is preferably effected by direct resistance heating. In this technique, described in detail in U.S. Pat. No. 3,908,431, the disclosure of which is incorporated herein by reference, an electrical current is passed through the steel workpiece whereby the electrical resistance of the workpiece to the flow of current causes rapid heating throughout the entire cross section of the workpiece. Without limiting the present invention as to theory, it is believed that the rapid heating, with minimal grain growth of the austenite being formed, is in part due to the uniform rapid heating afforded by the direct electrical resistance heating technique.

In heating according to this technique, the workpiece is preferably connected to a source of electric current, with the connection being made at both ends of the workpiece so that the current flows completely through the workpiece. Because the current flows uniformly through the workpiece, the temperature of the workpiece, usually in the form of a bar or rod, increases uniformly, both axially and radially. Thus, the interior as well as the exterior of the workpiece is heated simultaneously without introducing thermal strains. The uniformity in heating, as noted above, has the further advantage of preventing grain growth of austenite along the exterior of the workpiece while the interior of the workpiece is still being heated to the austenitizing temperature, as would be the case with a conventional furnace. In such a furnace, the exterior of the bar is heated much more rapidly than the interior.

One suitable means for heating the workpiece 10 by electrical resistance is schematically illustrated in FIG. 1 of the drawing. As shown, electrical contacts 12 and 14 are positioned in contact with the ends of the workpiece 10 whereby the flow of current between the two contacts 12 and 14 passes through the entire length of the workpiece and across its entire cross section. It is frequently preferred to subject the workpiece 10, during the time of the heating operation, to tension to compensate for thermal expansion of the workpiece 10 and to avoid buckling of the workpiece while at an elevated temperature. The slight tension exerted on the workpiece during the heating step thus serves to preserve the straightness of the workpiece and effects no plastic deformation thereof.

After transformation of the steel to austenite, the austenitic steel is quenched to transform the austenite to a fine mixture of (1) acicular pro-eutectoid ferrite and (2) a finely divided eutectoid aggregate of ferrite and iron carbide. As will be appreciated by those skilled in the art, the austenitic steel can be held at the austenitizing temperature for a time sufficient to permit all of the steel to be transformed. In general, complete conversion for most low carbon steels is effected in the time required to reach the austenitizing temperature, although there is no disadvantage incurred by holding the transformed austenitic steel at the austenitizing temperature as long as grain growth is minimized. When it is desired to hold the steel at the austenitizing temperature, it is possible, and frequently desirable, to employ a low austenitizing temperature.

Figure 6:
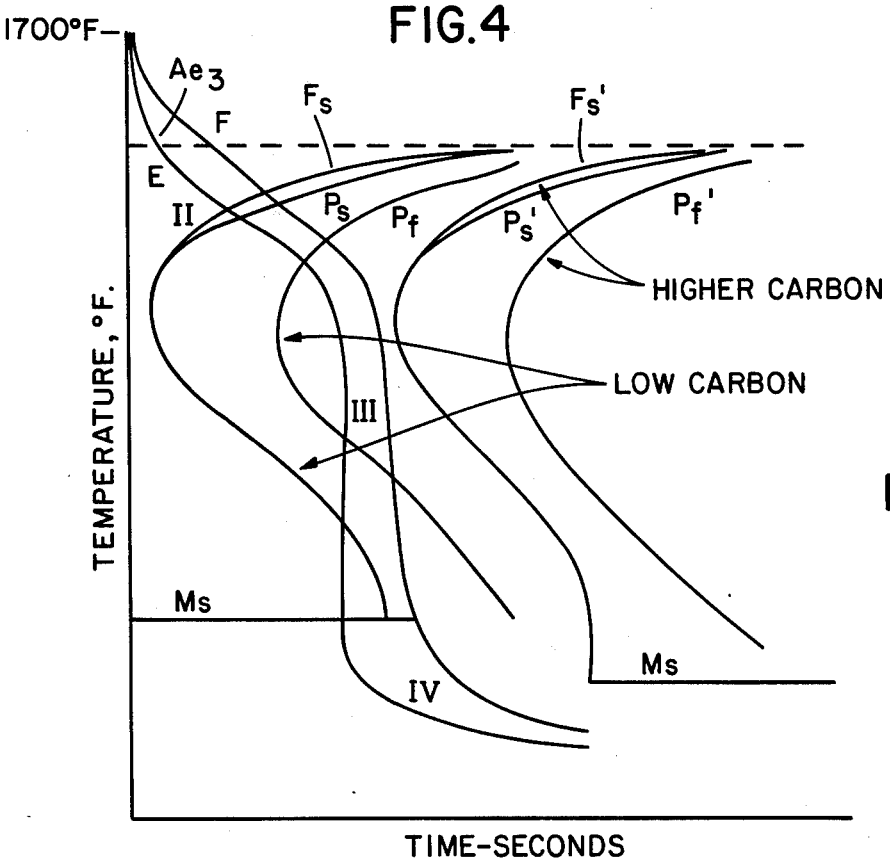
FIG. 6 is a graph illustrating the relationship of the cooling rate from austenitizing temperature and the final microstructure.

Again, without limiting the present invention as to theory, the heat treatment and quenching steps employed in the practice of this invention produce a fine mixture as described. The quench rate to obtain that fine mixture is an important parameter in the process of this invention. The concept of the quench rate as employed in the practice of this invention can best be understood by reference to FIG. 6 of the drawing, a schematic transformation diagram for both low and high carbon steels. FIG. 6 is a graphical representation of temperature versus time, and includes transformation curves A and B for a medium carbon steel. Curve $F_s$ represents the locus of time - temperature points at which the formation of ferrite begins to occur, whereas curve $P_s$ represents the locus of time - temperature points at which pearlite begins to occur and $P_f$ represents the completion of pearlite formation. In the region between those two curves $F_s$ and $P_s$ only ferrite is formed, but to the left of curve $P_s$, pearlite begins to form, and transformation is complete when the time - temperature reaches $P_f$.

Curves $F_s'$, $P_s'$ and $P_f'$ are the curves corresponding to the above for a high carbon steel. Thus, curve $F_s'$ is the curve beyond which ferrite begins to form whereas curve $P_s'$ represents the points beyond which pearlite begins to form, with transformation being complete by $P_f'$.

In the practice of this invention, the austenitized workpiece should be cooled at a rate such that the cooling curve intersects the transformation curves necessary for the formation of ferrite and pearlite. In the case of FIG. 6, curves E and F represent two different schematic cooling rates for the surface and center, respectively, of a workpiece processed in accordance with the process of this invention. They start at the austenitization temperature of 1700° F and proceed, on cooling, through a temperature ($Ae_3$) necessary for the transformation from austenite to ferrite-pearlite. The cooling rate continues but should intersect both curves $F_s$ and $P_f$, representing the transformation to ferrite and pearlite, respectively, and that transformation should be complete prior to the time that the cooling curves intersect the temperature for transformation to martensite (Ms). Curves E and F do intersect curves $F_s'$ and $P_f'$ for the low carbon steel, whereas those same curves do not intersect curves $F_s'$ and $P_f'$, representing the formation of ferrite and pearlite for a higher carbon steel.

Figure 7:
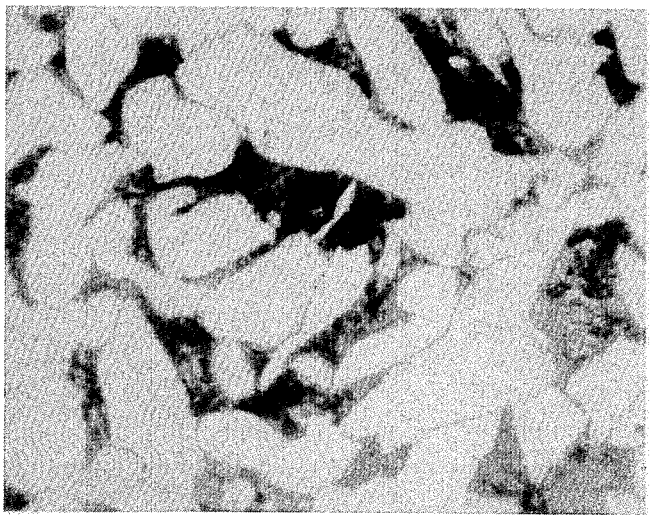
FIG. 7 is a photomicrograph of a conventional hot rolled low carbon steel.

Thus, in the practice of this invention, the cooling rate should be such that the austenite is transformed to acicular pro-eutectoid ferrite and a finely divided eutectoid mixture of ferrite and iron carbide. There is insufficient time to form the large grains of ferrite shown in FIG. 7, FIG. 7 representing the microstructure obtained in a hot rolled product by slow cooling. Most of the austenite is transformed to pearlite of a carbon content lower than the equilibrium carbon content. The small amount of ferrite which is formed nucleates within the austenite grain and does not have sufficient time to reach the grain boundary when the remaining austenite is transformed to pearlite, resulting in the acicular microstructure of the present invention, shown in FIG. 8.

Figure 8:
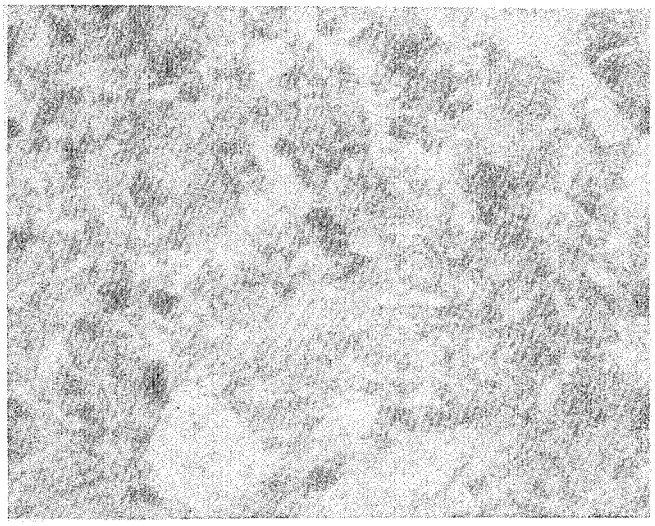
FIG. 8 is a photomicrograph of a low carbon steel embodying the concepts of this invention.

As is apparent from a comparison of FIG. 7 with FIG. 8, the hot rolled microstructure of FIG. 7 includes large grains of substantial quantities of ferrite, indicated in the light color, whereas the dark regions are pearlite. In contrast, FIG. 8, illustrating the microstructure of steels produced in the practice of this invention, includes a substantially smaller proportion of ferrite grains of much smaller dimensions. The ferrite grains in FIG. 8 are represented by the light regions, whereas the dark regions represent the finely divided eutectoid aggregate of ferrite and iron carbide.

As will be appreciated by those skilled in the art, to insure that the quenching step produces acicular proeutectoid ferrite and a finely divided mixture of ferrite and iron carbide, use can be made of a variety of quench media, depending on the carbon content and alloy content of the steel. It is generally preferred to effect the quenching of the austenitized workpiece in water, although other quenching media can be used, including oil, molten metals (such as molten lead) or molten salts. Water is generally preferred for low carbon steels since it has the effect of accelerating the rate of cooling.

As will be appreciated by those skilled in the art, the austenitizing temperature, the extent of water agitation and the addition of water-soluble components to the quench water can be employed, if desired, to more precisely control the cooling rate in a known manner.

The selection of the appropriate cooling rate, as indicated, depends upon the carbon level and alloy content for the particular steel processed, and that, in turn, depends upon the level of strength desired in the final product. The greater the carbon content of the steel, the greater is the maximum strength that can be obtained. For a steel with a given carbon content, the cooling rate is determined by continuous cooling transformation diagrams of the sort shown in FIG. 6 of the drawing. Diagrams of this sort for many carbon steels are available in the literature. The quench is thus selected to provide a cooling rate slow enough to avoid the formation of martensite or bainite, and fast enough to avoid the formation of large grain, pro-eutectoid ferrite of the type characteristic of hot rolled steel shown in FIG. 7 of the drawing.

The workpiece, after quenching in accordance with the practice of this invention, has the desired microstructure in the form of a fine mixture of acicular proeutectoid ferrite and a finely divided eutectoid mixture of ferrite and iron carbide. It has been unexpectedly found that the microstructure thus produced serves to provide a significant increase in the strength obtainable on working of the quenched workpiece. Thus, with the microstructure obtained in the practice of this invention, it is possible to obtain a larger increment of increase in strength as compared to non-heat treated stock.

The working step of the method of this invention is carried out by working the workpiece, as by drawing, extrusion, rolling and the like, at a temperature between room temperature and the lower critical temperature for the steel, that is the lowest temperature required to transform any portion of the steel to the austenite form. The working step serves to significantly strengthen the material to a strength level above that heretofore obtainable by working hot rolled carbon steels.

Figure 2:
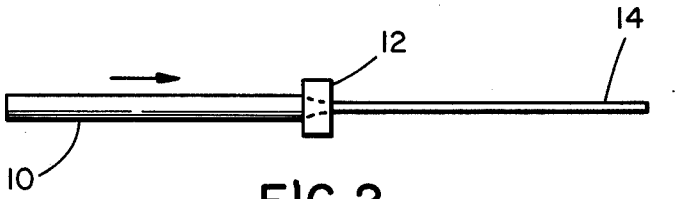
FIG. 2 is a schematic illustration of a drawing operation.

In accordance with the preferred practice of this invention, the workpiece which has been quenched as described above, preferably in the form of a rod, a bar or the like elongate piece of repeating cross section, is subjected to working to effect a reduction in the cross sectional area of the workpiece to produce a large increase in the strength of the workpiece. Preferred in the practice of this invention is drawing, as illustrated in FIG. 2, wherein the elongate workpiece 10 is simply advanced through a reduction die 16 to form the prestrengthened workpiece 18. The preferred workpiece can thus be characterized as a "drawing" operation, the details of which are well known to those skilled in the art.

The extent to which the quenched workpiece is subjected to working depends somewhat upon the particular steel processed as well as the properties desired in the final product. In general, when employing drawing, working to decrease the cross sectional area by 5 to 90%, and preferably 5 to 40%, is used.

The steel workpiece produced in the practice of this invention thus has a strength significantly higher than that obtainable by working a hot rolled workpiece to the same extent, and possesses significantly higher ductility.

Figure 3:
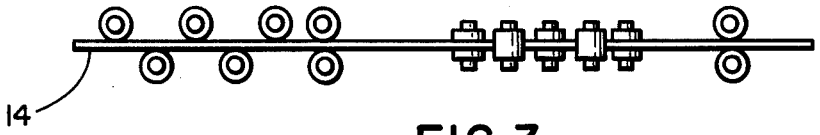
FIG. 3 is a schematic illustration of a straightening operation using a Lewis-type straightener.
Figure 4:
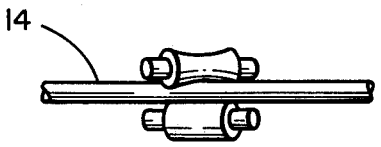
FIGS. 4 and 5 are schematic illustrations of the operation of a Medart-type straightener.
Figure 5:
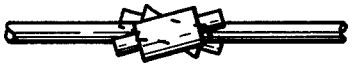

In the preferred practice of this invention, it is possible, and sometimes desirable, to subject the workpiece, after working, to a stress relieving operation. Such stress relieving operations are themselves now conventional and are described in U.S. Pat. No. 3,908,431, the disclosure of which is incorporated herein by reference. It is also possible to subject the workpiece to straightening prior to stress relieving. For this purpose, use can be made of conventional straightening equipment, such as a Lewis straightener, schematically illustrated in FIG. 3 of the drawing, or a Medart straightener machine, illustrated schematically in FIGS. 4 and 5. As is well known to those skilled in the art, such straightening equipment operates to straighten the workpiece by bending the workpiece in decreasing amounts of deflection.

Having described the basic concepts of the present invention, reference is now made to the following examples which are provided by way of illustration, and not by way of limitation, of the practice of this invention.

EXAMPLE 1

This example is presented for purposes of comparison. In this example, test bars from seven different heats of AISI/SAE grade 1018 steel, produced by rolling, are checked for chemical analysis and for mechanical properties.

The ladle analysis is as follows:

TABLE 1

| Heat Number | Carbon | Manganese | Phosphorus | Sulfur | Silicon |
|---|---|---|---|---|---|
| I | 0.19% | 0.71% | 0.007% | 0.019% | 0.018% |
| II | 0.19% | 0.83% | 0.005% | 0.019% | 0.042% |
| III | 0.17% | 0.73% | 0.007% | 0.018% | 0.03% |
| IV | 0.20% | 0.77% | 0.006% | 0.018% | 0.047% |
| V | 0.18% | 0.71% | 0.007% | 0.025% | 0.020% |
| VI | 0.18% | 0.78% | 0.007% | 0.022% | 0.044% |
| VII | 0.20% | 0.73% | 0.004% | 0.018% | 0.044% |

The mechanical properties of those hot rolled steels are as follows:

TABLE 2

| Heat Number | PSI Tensile Strength | PSI Yield Strength | Elongation | Reduction Of Area |
|---|---|---|---|---|
| I | 67,400 | 43,500 | 37.1% | 69.5% |
| II | 63,400 | 39,000 | 40.0% | 69.8% |
| III | 64,900 | 40,500 | 35.7% | 67.6% |
| III | 64,900 | 40,500 | 35.7% | 67.6% |
| IV | 66,500 | 44,700 | 38.6% | 70.3% |
| V | 61,800 | 42,200 | 38.6% | 71.5% |
| VI | 63,400 | 41,900 | 34.5% | 68.4% |
| VII | 61,900 | 35,900 | 35.5% | 69.0% |

Statistical parameters for that data showed the following:

TABLE 3

| Property | Mean | Standard Deviation | Maximum | Minimum | Range |
|---|---|---|---|---|---|
| Tensile Strength | 64,186 | 2012 | 67,400 | 61,800 | 5,600 |
| Yield Strength | 41,100 | 2735 | 44,700 | 35,900 | 8,800 |
| % Elongation | 37.14 | 1.86 | 40 | 34.5 | 5.5 |
| % Reduction Of Area | 69.44 | 1.18 | 71.5 | 67.6 | 3.9 |

Bars from those heats are subjected to a drawing operation with a draft of 20% (reduction in area), without any intermediate heat treatment. The bars resulting typically have the following properties:

TABLE 4

| | |
|---|---|
| Tensile Strength (PSI) | 88,000 |
| Yield Strength (PSI) | 75,000 |
| Elongation (%) | 17.5 |
| Reduction of Area (%) | 55.6 |

Thus, drawing of the hot rolled bars without any intermediate treatment serves to increase the tensile strength from about 64,000 p.s.i. to about 88,000 p.s.i. in accordance with conventional practice.

EXAMPLE 2

This example illustrates the practice of this invention.

Steel bars from the heats identified in Example 1 are austenitized at 1700° F by direct electrical resistance heating in about 2 minutes; thereafter, the bars are quenched with water.

The mechanical properties of the bars after quenching, but before drawing, are:

TABLE 5

| Heat Number | PSI Tensile Strength | PSI Yield Strength | Elongation | Reduction Of Area |
|---|---|---|---|---|
| I | 107,600 | 73,400 | 22.1% | 60.6% |
| II | 99,000 | 69,300 | 22.9% | 67.8% |
| III | 95,300 | 62,600 | 23.6% | 69.1% |
| IV | 100,300 | 65,500 | —* | 64.9% |
| V | 94,400 | 61,400 | 24.0% | 65.7% |
| VI | 86,300 | 59,700 | 25.0% | 72.4% |

* Specimen broke outside gauge length.

The statistical data for those heats is as follows:

TABLE 6

| Property | Mean | Standard Deviation | Maximum | Minimum | Range |
|---|---|---|---|---|---|
| Tensile Strength | 99,320 | 4690 | 107,600 | 94,400 | 13,200 |
| Yield Strength | 66,400 | 4419 | 73,400 | 61,400 | 12,000 |
| % Elongation | 23.52 | 0.98 | 25 | 22.1 | 2.9 |
| % Reduction Of Area | 65.62 | 2.92 | 69.1 | 60.6 | 8.5 |

After quenching, the bars are pointed, cleaned and cold drawn with a reduction in area of 30%. The mechanical properties for those bars are as follows:

TABLE 7

| Heat Number | PSI Tensile Strength | PSI Yield Strength | Elongation | Reduction Of Area |
|---|---|---|---|---|
| I | 145,900 | 145,900 | 12.1% | 52.9% |
| | 143,700 | 143,700 | 10.0% | 43.7% |
| | 149,000 | 149,000 | 10.7% | 47.3% |
| II | 138,300 | 138,300 | 11.4% | 53.2% |
| | 139,300 | 139,300 | 12.1% | 54.9% |
| | 137,500 | 137,500 | 11.4% | 55.1% |
| III | 139,900 | 134,900 | — | 54.8% |
| | 140,400 | 140,400 | 10.7% | 50.1% |
| | 138,500 | 138,500 | 11.4% | 52.0% |
| IV | 146,400 | 146,400 | 11.4% | 52.1% |
| | 147,700 | 147,700 | 10.0% | 48.5% |
| | 146,000 | 146,000 | 11.4% | 53.9% |
| V | 156,600 | 156,600 | 9.3% | 42.4% |
| VI | 136,800 | 136,800 | 11.5% | 52.0% |
| | 134,800 | 134,800 | — | 53.1% |
| | 137,200 | 137,200 | 11.5% | 53.5% |

The statistical parameters for that data are:

TABLE 8

| Property | Mean | Standard Deviation | Maximum | Minimum | Range |
|---|---|---|---|---|---|
| Tensile Strength | 142,380 | 5636 | 156,600 | 134,800 | 21,800 |
| Yield Strength | 142,060 | 5897 | 156,600 | 134,800 | 21,800 |
| % Elongation | 11.06 | 0.79 | 12.1 | 9.3 | 2.8 |
| % Reduction Of Area | 51.22 | 3.75 | 55.1 | 42.4 | 12.7 |

As can be seen from the foregoing data, the mean tensile strength after quenching but before drawing (from Table 6) is 99,320 psi as compared to a mean tensile strength of about 64,000 psi for hot rolled steel. The tensile strength after drawing (from Table 8) is about 142,000 psi, as compared to a tensile strength of about 88,000 psi for drawn, hot rolled bars. The data also shows that ductility of the bars, as measured by the percent reduction of area, in the practice of this invention, is retained with a highly significant increase of strength.

EXAMPLE 3

Using the same procedure as described in Example 2, a series of bars from the heats identified in Example 1 is austenitized for two minutes, water quenched and then subjected to cold drawing with a draft of 20%.

The data, including the statistical parameters for those bars, is shown in the following tables:

TABLE 9

| Heat Number | PSI Tensile Strength | PSI Yield Strength | Elongation | Reduction Of Area |
|---|---|---|---|---|
| I | 142,500 | 142,500 | 11.4% | 46.9% |
| | 139,000 | 139,000 | 11.4% | 55.8% |
| | 136,000 | 136,000 | 11.4% | 52.8% |
| II | 128,600 | 128,600 | 12.9% | 59.7% |
| | 129,100 | 129,100 | 12.9% | 56.3% |
| | 131,400 | 131,400 | 12.9% | 61.6% |
| III | 134,100 | 134,100 | 10.7% | 66.9% |
| | 130,600 | 130,600 | 11.4% | 50.4% |
| | 134,600 | 134,600 | 11.4% | 50.4% |
| IV | 138,400 | 138,400 | 11.4% | 53.4% |
| | 137,300 | 137,300 | 12.1% | 54.3% |
| | 136,600 | 136,600 | 12.1% | 53.5% |
| V | 146,900 | 146,900 | 10.0% | 49.3% |
| VI | 126,100 | 125,800 | 12.5% | 59.4% |
| | 127,500 | 127,500 | 12.0% | 55.4% |
| | 129,600 | 128,800 | 12.5% | 53.9% |

TABLE 10

| Property | Mean | Standard Deviation | Maximum | Minimum | Range |
|---|---|---|---|---|---|
| Tensile Strength | 134,200 | 5587 | 146,900 | 126,100 | 20,800 |
| Yield Strength | 134,200 | 5659 | 146,900 | 125,800 | 21,100 |
| % Elongation | 11.81 | 0.8 | 12.9 | 10 | 2.9 |
| % Reduction Of Area | 55 | 4.88 | 66.9 | 46.9 | 20 |

Again, a significant increase in tensile strength is realized, while maintaining ductility as measured by percent reduction of area as compared to hot rolled steel.

EXAMPLE 4

Again, using the same procedure described in Example 2, steel bars from the heats identified in Example 1 are austenitized, quenched in water and subjected to cold drawing with a draft of 20%.

Thereafter, the bars are subjected to strain relieving in accordance with the procedure described in U.S. Pat. No. 3,908,431 at 600° F.

The data for those bars, after strain relieving, is shown in the following tables:

TABLE 11

| Heat Number | PSI Tensile Strength | PSI Yield Strength | Elongation | Reduction Of Area |
|---|---|---|---|---|
| I | 136,300 | 136,300 | 13.6% | 54.3% |
| II | 126,400 | 125,900 | 14.3% | 61.3% |
| III | 132,400 | 131,900 | 12.9% | 54.8% |
| IV | 134,200 | 134,200 | 14.3% | 57.5% |
| V | 123,300 | 122,300 | 15.0% | 60.8% |

TABLE 12

| Property | Mean | Standard Deviation | Maximum | Minimum | Range |
|---|---|---|---|---|---|
| Tensile Strength | 130,500 | 4891 | 136,300 | 123,300 | 13,000 |
| Yield Strength | 130,100 | 5234 | 136,300 | 122,300 | 14,000 |
| % Elongation | 14.02 | 0.71 | 15 | 12.9 | 2.1 |
| % Reduction Of Area | 57.74 | 2.92 | 61.3 | 54.3 | 7 |

The data from the foregoing bars shows that the strain relieving operation provides high tensile and yield strengths while again maintaining a high level of ductility as measured by percent reduction of area.

EXAMPLE 5

Again, using the same procedure described in Example 2, steel bars from the heats identified in Example 1 are austenitized, quenched in water and subjected to cold drawing with a draft of 20%.

Thereafter, the bars are subjected to strain relieving in accordance with the procedure described in U.S. Pat. No. 3,908,431 at 650° F.

The data for those bars, after strain relieving, is shown in the following tables:

TABLE 13

| Heat Number | PSI Tensile Strength | PSI Yield Strength | Elongation | Reduction Of Area |
|---|---|---|---|---|
| I | 137,400 | 134,900 | 15.0% | 59.2% |
| II | 126,000 | 124,200 | 15.7% | 61.9% |
| III | 127,400 | 125,900 | 15.7% | 62.3% |
| IV | 130,600 | 129,600 | 15.0% | 60.2% |
| V | 120,800 | 119,800 | 16.5% | 61.6% |

TABLE 14

| Property | Mean | Standard Deviation | Maximum | Minimum | Range |
|---|---|---|---|---|---|
| Tensile Strength | 128,440 | 5484 | 137,400 | 120,800 | 16,600 |
| Yield Strength | 126,880 | 5099 | 134,900 | 119,800 | 15,100 |
| % Elongation | 15.58 | 0.56 | 16.5 | 15 | 1.5 |
| % Reduction Of Area | 61.04 | 1.16 | 62.3 | 59.2 | 3.1 |

Comparable results are thus achieved.

EXAMPLE 6

Again, using the same procedure described in Example 2, steel bars from the heats identified in Example 1 are austenitized, quenched in water and subjected to cold drawing with a draft of 20%.

Thereafter, the bars are subjected to strain relieving in accordance with the procedure described in U.S. Pat. No. 3,908,431 at 700° F.

The data for those bars, after strain relieving, is shown in the following tables:

TABLE 15

| Heat Number | PSI Tensile Strength | PSI Yield Strength | Elongation | Reduction Of Area |
|---|---|---|---|---|
| I | 129,100 | 128,900 | 15.7% | 61.3% |
| II | 123,600 | 122,100 | 17.1% | 63.3% |
| III | 127,400 | 125,900 | 15.7% | 60.2% |
| IV | 129,400 | 126,600 | 17.1% | 62.5% |
| V | 132,900 | 128,900 | 17.1% | 63.0% |
| VI | 121,300 | 118,300 | 16.0% | 61.9% |

TABLE 16

| Property | Mean | Standard Deviation | Maximum | Minimum | Range |
|---|---|---|---|---|---|
| Tensile Strength | 127,280 | 3845 | 132,900 | 121,300 | 11,600 |
| Yield Strength | 125,120 | 3808 | 128,900 | 118,300 | 10,600 |
| % Elongation | 16.45 | 0.66 | 17.1 | 15.7 | 1.4 |
| % Reduction Of Area | 62.03 | 1.06 | 63.3 | 60.2 | 3.1 |

EXAMPLE 7

Using the same procedure described in Example 2, steel bars from the heats identified in Example 1 are austenitized, quenched in water and subjected to cold drawing with a draft of 30%.

Thereafter, the bars are subjected to strain relieving in accordance with the procedure described in U.S. Pat. No. 3,908,431 at 600° F.

The data for those bars, after strain relieving, is shown in the following tables:

TABLE 17

| Heat Number | PSI Tensile Strength | PSI Yield Strength | Elongation | Reduction Of Area |
|---|---|---|---|---|
| I | 148,500 | 148,500 | 13.6% | 56.6% |
| II | 137,500 | 137,500 | 12.9% | 56.6% |

TABLE 17-continued

| Heat Number | PSI Tensile Strength | PSI Yield Strength | Elongation | Reduction Of Area |
|---|---|---|---|---|
| III | 137,900 | 137,900 | 13.6% | 55.9% |
| IV | 141,200 | 141,200 | 14.3% | 57.5% |

TABLE 18

| Property | Mean | Standard Deviation | Maximum | Minimum | Range |
|---|---|---|---|---|---|
| Tensile Strength | 141,280 | 4412 | 148,500 | 137,500 | 11,000 |
| Yield Strength | 141,280 | 4412 | 148,500 | 137,500 | 11,000 |
| % Elongation | 13.6 | 0.50 | 14.3 | 12.9 | 1.4 |
| % Reduction Of Area | 56.65 | 0.57 | 57.5 | 55.9 | 1.6 |

EXAMPLE 8

Using the same procedure described in Example 2, steel bars from the heats identified in Example 1 are austenitized, quenched in water and subjected to cold drawing with a draft of 30%.

Thereafter, the bars are subjected to strain relieving in accordance with the procedure described in U.S. Pat. No. 3,908,431 at 650° F.

The data for those bars, after strain relieving, is shown in the following tables:

TABLE 19

| Heat Number | PSI Tensile Strength | PSI Yield Strength | Elongation | Reduction Of Area |
|---|---|---|---|---|
| I | 139,500 | 139,500 | 14.3% | 56.9% |
| II | 134,400 | 134,400 | 15.0% | 60.2% |
| III | 134,900 | 134,900 | 14.3% | 59.2% |
| IV | 139,000 | 139,000 | 14.3% | 60.2% |
| V | 130,600 | 128,800 | 15.0% | 59.9% |

TABLE 20

| Property | Mean | Standard Deviation | Maximum | Minimum | Range |
|---|---|---|---|---|---|
| Tensile Strength | 135,680 | 3276 | 139,500 | 130,680 | 8,900 |
| Yield Strength | 135,320 | 3861 | 139,500 | 128,800 | 10,700 |
| % Elongation | 14.58 | 0.34 | 15.0 | 14.3 | 0.7 |
| % Reduction Of Area | 59.3 | 1.24 | 60.2 | 56.9 | 3.3 |

EXAMPLE 9

Using the same procedure described in Example 2, steel bars from the heats identified in Example 1 are austenitized, quenched in water and subjected to cold drawing with a draft of 30%.

Thereafter, the bars are subjected to strain relieving in accordance with the procedure described in U.S. Pat. No. 3,908,431 at 700° F.

The data for those bars, after strain relieving, is shown in the following tables:

TABLE 21

| Heat Number | PSI Tensile Strength | PSI Yield Strength | Elongation | Reduction Of Area |
|---|---|---|---|---|
| I | 137,400 | 137,400 | 14.3% | 59.5% |
| II | 129,600 | 129,600 | 15.0% | 62.6% |
| III | 130,300 | 128,300 | 15.7% | 62.5% |
| IV | 137,400 | 137,400 | 15.0% | 62.0% |
| V | 125,000 | 122,800 | 16.0% | 62.4% |

TABLE 22

| Property | Mean | Standard Deviation | Maximum | Minimum | Range |
|---|---|---|---|---|---|
| Tensile Strength | 132,100 | 4590 | 137,400 | 125,800 | 11,600 |
| Yield Strength | 131,100 | 5627 | 137,400 | 122,800 | 14,600 |

TABLE 22-continued

| Property | Mean | Standard Deviation | Maximum | Minimum | Range |
|---|---|---|---|---|---|
| % Elongation | 15.2 | 0.60 | 16.0 | 14.3 | 1.7 |
| % Reduction Of Area | 61.8 | 1.17 | 62.6 | 59.5 | 3.1 |

Data from the foregoing examples is summarized in the following table:

TABLE 23

SUMMARY MEAN MECHANICAL PROPERTIES

| | 20% COLD DRAWN | | | | | |
|---|---|---|---|---|---|---|
| | | | | Strain Relieved at: | | |
| Property | Hot Roll | Water Quench | Cold Drawn | 600° F. | 650° F. | 700° F. |
| Tensile Strength (PSI) | 64,000 | 99,000 | 134,000 | 130,000 | 128,000 | 127,000 |
| Yield Strength (PSI) | 41,000 | 66,000 | 134,000 | 130,000 | 126,000 | 125,000 |
| Elongation (%) | 37 | 23 | 11.8 | 14 | 15.6 | 16.5 |
| Reduction of Area (%) | 69 | 65 | 55 | 57 | 61 | 62 |

| | 30% COLD DRAWN | | | | | |
|---|---|---|---|---|---|---|
| | | | | Strain Relieved at: | | |
| Property | Hot Roll | Water Quench | Cold Drawn | 600° F. | 650° F. | 700° F. |
| Tensile Strength (PSI) | 64,000 | 99,000 | 142,000 | 141,000 | 136,000 | 132,000 |
| Yield Strength (PSI) | 41,000 | 66,000 | 142,000 | 141,000 | 135,000 | 131,000 |
| Elongation (%) | 37 | 23 | 11 | 13.6 | 14.6 | 15.2 |
| Reduction of Area (%) | 69 | 65 | 51 | 55.7 | 59.3 | 61.8 |

| CONVENTIONALLY 20% COLD DRAWN 1018 | |
|---|---|
| Tensile Strength (PSI) | 88,000 |
| Yield Strength (PSI) | 75,000 |
| Elongation (%) | 17.5 |
| Reduction of Area (%) | 55.6 |

The foregoing data shows that the practice of the present invention provides a steel in which the initial hot rolled strength of about 60,000 psi is practically doubled to provide steels having strengths above 130,000 psi. Significant here is the fact that the strength increments obtained are much greater than what can be obtained by a comparable cold drawing of hot rolled steel. The practice of the prior art provides a tensile strength of about 88,000 psi for hot rolled steel which has been subjected to drawing as compared to a tensile strength of about 134,000 psi obtained in the practice of this invention. In addition to that, the percent reduction of area, a measure of the ductility, is only very slightly affected by the practice of this invention, thus providing steels which have extremely high strengths while maintaining a high level of ductility.

EXAMPLE 10

This example illustrates the use of a steel having a higher carbon content, AISI/SAE steel No. 1144.

This steel, in hot rolled form, after cold drawing and after elevated temperature drawing, has the following mechanical properties.

TABLE 24

| Property | Hot Rolled | Cold Drawn | Elevated Temperature Drawn at 650° F |
|---|---|---|---|
| Tensile Strength | 107,300 | 148,200 | 165,300 |
| Yield Strength | 60,200 | 146,600 | 163,200 |
| % Elongation | 16 | 7 | 6 |
| % Reduction Of Area | 30 | 23.6 | 16.5 |

Bars of No. 1144 Steel are austenitized at 1550° F and then quenched into molten lead at a temperature of 650° F for 1 minute. The bars are then subjected to elevated temperature drawing at 650° F in a draft of 20%. The resulting mechanical properties are as follows:

TABLE 25

| | |
|---|---|
| Tensile Strength | 181,700 |
| Yield Strength | 178,600 |
| % Elongation | 8 |
| % Reduction of Area | 27.8 |

As can be seen from the foregoing data, the strength obtained is drastically improved over that obtainable by either cold drawing or elevated temperature drawing. Not only is the strength improved, but the ductility, as measured by percent reduction of area, is comparable to that of the initial hot rolled material.

EXAMPLE 11

Using the same steel as described in Example 10, steel bars are austenitized at 1800° F, quenched into molten lead at 650° F for 1 minute and then subjected to elevated temperature drawing at 650° F with a draft of 20%. The properties for those bars are reported below:

TABLE 26

| | |
|---|---|
| Tensile Strength | 181,200 |
| Yield Strength | 178,600 |
| % Elongation | 10 |
| % Reduction of Area | 33.2 |

Again, a substantial increase in strength is obtained.

EXAMPLE 12

Using the same procedure as described in Example 11, bars of No. 1144 steel are austenitized at 1850° F, quenched into molten lead for one minute, and air cooled to room temperature. The bars are then reheated to 650° F and drawn at that temperature with a draft of 20%. The mechanical properties of those bars are shown below:

TABLE 27

| | |
|---|---|
| Tensile Strength | 194,500 |
| Yield Strength | 193,800 |
| % Elongation | 7 |
| % Reduction of Area | 26.5 |

A comparison of Examples 11 and 12 reveals that an intermediate air cooling step following the quench step has no detrimental affect in the practice of this invention. Without limiting the invention as to theory, it is believed that the reason for that is due to the fact that the quenching operation serves to complete the conversion of the austenitized steel to a fine mixture of acicular pro-eutectoid ferrite and a finely divided eutectoid mixture of ferrite and iron carbide. That complete conversion is one of the characteristics of this invention and distinguishes it from the process described in U.S. Pat. No. 3,240,634. In the process described in that patent, steels are subjected to working before the transformation of the austenite to form bainite is completed, whereas in the process of this invention, the transformation of the austenite to ferrite is substantially complete before working is begun. The steels thus differ significantly in their resulting mechanical properties.

It will be understood that various changes and modifications can be made in the details of formulation, procedure and equipment without departing from the spirit of the invention, especially as defined in the following claims.

I claim:

1. A method for the strengthening of a carbon steel comprising the steps of (1) rapidly heating the carbon steel to raise the temperature of the steel into the austenite region at a rate sufficient to minimize grain growth of austenite grains, (2) cooling the austenitized carbon steel to transform the steel to a fine mixture of acicular pro-eutectoid ferrite and a finely divided eutectoid aggregate of ferrite and iron carbide, and (3) working the resulting steel to strengthen the steel.

2. A method as defined in claim 1 wherein the carbon steel has a carbon content ranging from 0.1% carbon by weight up to the eutectoid carbon level for the steel.

3. A method as defined in claim 1 wherein the carbon steel is within the range of 0.1 to 0.5% carbon by weight.

4. A method is defined in claim 1 wherein the steel is heated into the austenite region at a temperature ranging from 1350° to 2000° F.

5. A method as defined in claim 1 wherein the steel is heated into the austenite region in a time less than ten minutes.

6. A method as defined in claim 1 wherein the steel is heated into the austenite region by passing an electrical current through the workpiece.

7. A method as defined in claim 1 wherein the steel is quenched with water.

8. A method as defined in claim 1 wherein the steel is worked by extrusion through a reduction die.

9. A method as defined in claim 8 wherein the extrusion die serves to reduce the cross sectional area of the steel by an amount ranging from 5 to 90%.

10. A method as defined in claim 1 wherein the working is carried out at a temperature below the lower critical temperature for the steel.

11. A method as defined in claim 1 which includes the step of stress relieving the steel to produce a steel having high levels of mechanical properties with low levels of residual stress.

12. A method as defined in claim 1 which includes the step of straightening the steel.

13. A prestrengthened steel workpiece formed of a carbon steel prepared by the method of claim 1.

14. A steel as defined in claim 13 wherein the steel has a carbon content from 0.1% carbon by weight up to the eutectoid carbon level.

15. A steel as defined in claim 13 wherein the steel is an AISI/SAE 1018 steel.

16. A prestrengthened, stress relieved steel workpiece formed of a carbon steel prepared by the method of claim 11.

17. A steel as defined in claim 13 wherein the steel contents 0.1 to 0.8% by weight C, 0.50 to 1.65 by weight Mn, 0.01 to 0.50% by weight S, and 0.10 to 0.35% by weight Si, with the remainder being iron and its usual impurities.

18. A method for the strengthening of a hypoeutectoid carbon steel comprising the steps of (1) rapidly heating the steel to a temperature within the austenite region at a rate sufficient to minimize grain growth of austenite grains, (2) quenching the austenite steel to produce a fine mixture of acicular pro-eutectoid ferrite and a finely divided eutectoid aggregate of ferrite and iron carbide, (3) working the resulting steel at a temperature ranging up to the lower critical temperature to strengthen the steel and (4) stress relieving the steel to produce a steel having high levels of mechanical properties with low levels of residual stress.

19. A method as defined in claim 18 wherein the carbon steel is within the range of 0.1 to 0.5% carbon by weight.

20. A method as defined in claim 18 wherein the steel is heated into the austenite region at a temperature ranging from 1350° to 2000° F.

21. A method as defined in claim 18 wherein the steel is heated into the austenite region in a time less than ten minutes.

22. A method as defined in claim 18 wherein the steel is heated into the austenite region by passing an electrical current through the workpiece.

23. A method as defined in claim 18 wherein the steel is quenched with water.

24. A method as defined in claim 18 wherein the steel is worked by extrusion through a reduction die.

25. A method as defined in claim 18 which includes the step of straightening the steel.

26. A prestrengthened steel workpiece formed of a carbon steel prepared by the method of claim 18.

27. A method for the strengthening of a hypoeutectoid carbon steel comprising the steps of (1) rapidly heating by passing an electrical current through the steel to heat the steel substantially uniformly across the cross section thereof to a temperature within the austenite region, with the rate of heating being sufficient to minimize grain growth of austenite grains, (2) quenching the austenite steel to produce a fine mixture of acicular pro-eutectoid ferrite and a finely divided eutectoid aggregate of ferrite and iron carbide and (3) working the resulting steel at a temperature ranging up to the lower critical temperature for the steel to strengthen the steel.

28. A method as defined in claim 27 wherein the carbon steel is within the range of 0.1 to 0.5% carbon by weight.

29. A method as defined in claim 27 wherein the steel is heated into the austenite region in a time less than ten minutes.

30. A method as defined in claim 27 wherein the steel is quenched with water.

31. A method as defined in claim 27 which includes the step of stress relieving the steel to produce a steel having high levels of mechanical properties with low levels of residual stress.

* * * * *